US005403358A

United States Patent [19]

Aston et al.

[11] Patent Number: 5,403,358

[45] Date of Patent: Apr. 4, 1995

[54] INK JET PRINTING PROCESS AND PRETREATMENT COMPOSITION CONTAINING A QUATERNARY AMMONIUM COMPOUND

[75] Inventors: Sarah O. Aston, Manchester; John R. Provost, Chorley, both of England

[73] Assignee: Imperial Chemical Industries PLC, London, England

[21] Appl. No.: 947,791

[22] Filed: Sep. 21, 1992

[30] Foreign Application Priority Data

Sep. 23, 1991 [GB] United Kingdom ..... 9120227

[51] Int. Cl.[6] ..... D06M 13/322; D06P 5/00

[52] U.S. Cl. ..... 8/445; 8/543; 8/580; 8/585; 8/606; 8/188; 8/930; 8/933

[58] Field of Search ..... 8/543, 606, 585, 580, 8/188, 930, 445, 933

[56] References Cited

U.S. PATENT DOCUMENTS

| | | | |
|---|---|---|---|
| 4,017,256 | 5/1977 | Kogel et al. | 8/543 |
| 4,411,665 | 10/1983 | Egli et al. | 8/455 |
| 5,147,411 | 9/1992 | Töpfl | 8/606 |

FOREIGN PATENT DOCUMENTS

| | | |
|---|---|---|
| 1483892 | 6/1967 | France . |
| 3329445 | 3/1985 | Germany . |
| 56-68174 | 6/1981 | Japan . |
| 61-132688 | 6/1986 | Japan . |
| 63-168382 | 7/1988 | Japan . |
| 488099 | 6/1938 | United Kingdom . |

OTHER PUBLICATIONS

WIPL/Derwent, Week 8329, AN 83-715231 & SU-A-956 667 7 Sep. 1982.

Derwent Abstract 86-200823/31; Jun. 1986.

The Textile Manufacturer, Mar. 1967, pp. 115-121.

*Primary Examiner*—Paul Lieberman

*Assistant Examiner*—Caroline L. Dusheck

*Attorney, Agent, or Firm*—Cushman Darby & Cushman

[57] ABSTRACT

A color enhancing agent comprising water, urea and a quaternary ammonium compound of the Formula (1):

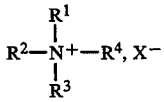

(1)

wherein:

$R^1$, $R^2$ and $R^3$ are each independently selected from H and $C_{1-20}$-optionally substituted alkyl or alkylene;

$R^4$ is $C_{1-20}$-optionally substituted alkyl or alkylene; and $X^-$ is an anion, provided that the total number of carbon atoms in the compound of Formula (1) is more than 30. The color enhancing agent can be used in pre-treatment compositions for textile materials prior to ink jet printing with a reactive dye and improves color yields.

7 Claims, No Drawings

INK JET PRINTING PROCESS AND PRETREATMENT COMPOSITION CONTAINING A QUATERNARY AMMONIUM COMPOUND

PRINTING PROCESS AND PRETREATMENT COMPOSITION

This specification describes an invention relating to an ink jet printing (IJP) process for the coloration of textile materials with reactive dyes, to a pre-treatment composition suitable for use in the process, and to a colour enhancing agent suitable for incorporation to the pre-treatment composition. The process and composition are particularly suitable for the pre-production of small authentic prints on textile material for the assessment of pattern, colour and print quality before embarking on the preparation of engraved rollers or patterned screens for use in the production of commercial quantities of printed textile material.

It is known that textiles may be printed with a dye by IJP. Various pre-treatments have been proposed which purport to improve the quality of resultant print. For example, Seiren in Japanese patent application no. 63-197176 proposed pre-treating a textile using a non-dyeing compound such as gum arabic or shellac gum and a low temperature plasma treatment. Although known pre-treatments are useful there is a continuing need for improved and/or simplified pre-treatments specifically adapted for the ink jet printing of textiles with reactive dyes.

We have now found that colour yield of a textile printed by IJP using a reactive dye may be enhanced by pre-treating the textile with a composition containing a colour enhancing agent which comprises urea and a quaternary ammonium compound.

According to the present invention there is provided a colour enhancing agent comprising a water, urea and a quaternary ammonium compound.

The preferred quaternary ammonium compound is of the Formula (1):

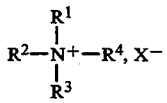

(1)

wherein:

$R^1$, $R^2$ and $R^3$ are each independently selected from H and $C_{1-20}$-optionally substituted alkyl or alkylene;

$R^4$ is $C_{1-20}$-optionally substituted alkyl or alkylene; and $X^-$ is an anion, provided that the total number of carbon atoms in the compound of Formula (1) is more than 30.

The term "alkylene" means an alkyl chain containing one or more than one —CH=CH— unit.

It is preferred that $R^1$ and $R^2$ are each independently selected from $C_{1-20}$ alkyl or alkylene, more preferably $C_{1-4}$-alkyl, especially methyl.

$R^3$ and $R^4$ are preferably each independently $C_{5-20}$-alkyl or alkylene, especially $C_{16-20}$-alkyl or alkylene especially $C_{18}$-alkyl When any of the groups $R^1$, $R^2$, $R^3$ or $R^4$ is alkyl or alkylene it may be branched, and is preferably straight chain (i.e., without branches) alkyl or alkylene.

As examples of alkyl groups represented by $R^1$, $R^2$, $R^3$ and $R^4$ there may be mentioned groups of formula $-(CH_2)_nCH_3$ wherein n has a value of from 0 to 19.

It is preferred that $R^3$ and $R^4$ are each independently of formula $-(CH_2)_nCH_3$ wherein n is from 9 to 19, especially 15 to 19, more especially 17.

Preferably $R^1$ and $R^2$ are identical to one another. In one embodiment $R^2$, $R^3$ and $R^4$ are identical to one another.

As specific examples of quaternary ammonium compounds of Formula (1) there may be mentioned distearyl dimethyl ammonium salts.

The nature of the anion represented by $X^-$ is not believed to be critical. As examples of a suitable anion there may be mentioned $\frac{1}{2}$ ($SO_4^{2-}$) halo$^-$ and especially $Cl^-$.

The preferred compounds of Formula (1) contain from 30 to 50, more preferably 32 to 48 especially 36 to 40 carbon atoms.

The colour enhancing agent preferably contains sufficient water to ensure complete solution of all components. Typically the colour enhancing agent contains at least 50%, preferably at least 60%, especially from 60% to 80% water. In this specification all percentages are by weight.

The colour enhancing agent preferably contains from 5 to 50%, more preferably 10% to 40%, especially 10% to 30%, more especially around 25% of urea.

The amount of quaternary ammonium compound in the colour enhancing agent is preferably present in the range 1% to 20%, more preferably 1% to 5%, especially around 3%.

The colour enhancing agent may also contain an agent which enhances the solubility of the quaternary ammonium compound in water, for example a water miscible organic solvent, especially a lower alcohol such as propan-2-ol. The amount of solubility enhancing agent depends on the solubility and relative amount of quaternary ammonium compound to water. However, it is preferred for reasons of economy that the composition contains less than 10%, more preferably less than 2.5%, especially from 0.1 to 2.5% of the solubility enhancing agent.

We have also found that "the feel", that is to say the handle of the printed, steamed and washed textile pretreated according to the invention and printed with a reactive dye using IJP is improved by adding castor oil +2.5 or 4.0 ethylene oxide adduct to the colour enhancing agent, preferably in quantity of from 1 to 10%, especially from 1 to 5%.

Castor oil +2.5 ethylene oxide adduct comprises 97.5% castor oil and 2.5% castor oil ethylene oxide adduct. Castor oil +4.0 ethylene oxide adduct comprises 96% castor oil and 4% castor oil ethylene oxide adduct.

In addition to the aforementioned components the colour enhancing agent may also contain from 0.001 to 0.5% of sodium lauryl sulphate, from 0.00005 to 0.0005% of formaldehyde, from 0.1 to 0.5% of Tallow amine +ethylene oxide adduct and from 0.01 to 0.1% of an organic acid, such as acetic acid.

Tallow amine +15 ethylene oxide adduct comprises 85% Commercial Tallowamine and 15% Tallowamine ethylene oxide adduct.

Accordingly a preferred colour enhancing agent for use in the invention comprises the following components, wherein all percentages are by weight of total colour enhancing agent:

| | |
|---|---|
| Urea | from 10 to 30%; |
| Quaternary ammonium compound | from 1 to 20%; |
| Solubility enhancing agent | from 0.1 to 2.5%; |
| Sodium lauryl sulphate | from 0.001 to 0.5%; |
| Tallow amine + 15 ethylene oxide | from 0.01 to 0.5%; |
| Castor oil + 2.5 or 4.0 ethylene oxide | from 1 to 5%; and |
| Water | from 60 to 80%. |

The more preferable ranges of each of the above components are as hereinbefore defined.

The preferred colour enhancing agent preferably also contains formaldehyde and acetic acid as described above.

The colour enhancing agent may be mixed with a base, a thickening agent and optionally a hydrotropic agent to give a pre-treatment composition suitable for application to textiles prior to ink jet printing thereof with an ink containing a reactive dye.

For effective colour enhancement it is preferred that the pre-treatment composition contains from 5% to 50%, more preferably from 10% to 30%, and especially about 20% by weight of colour enhancing agent.

The amount of base may be varied within wide limits provided sufficient base is retained on the textile material after pre-treatment to promote the formation of a covalent bond between the reactive dye and the pretreated textile material. The base is preferably an alkali metal hydroxide, carbonate, bicarbonate or a mixture thereof. It is convenient to use a concentration of from 1% to 5% by weight based on the total weight of the composition. A particularly preferred base is an alkali metal bicarbonate, especially sodium bicarbonate.

The pre-treatment composition may contain a thickening agent suitable for use in the preparation of print pastes for the conventional printing of cellulose reactive dyes. Suitable thickening agents include alginates, especially sodium alginate, xantham gums, monogalactam thickeners and cellulosic thickeners. The amount of the thickening agent can vary within wide limits depending on the relationship between concentration and viscosity. However, sufficient agent is preferred to give a viscosity from 10 to 1000 mPa.s, preferably from 10 to 100 mPa.s, (measured on a Brookfield RVF Viscometer). For an alginate thickener this range can be provided by using from 10% to 20% by weight based on the total weight of the pre-treatment composition. It is preferred that the pre-treatment composition and colour enhancing agent do not contain a dye.

According to a second aspect of the invention there is provided a process for the coloration of a textile comprising the steps of:

(i) applying to the textile a pre-treatment composition as hereinbefore defined; and (ii) ink jet printing the product from step (i) with an ink containing a reactive dye.

The processes of the present invention may be performed on a wide range of textiles such as natural polyamides and cellulosic materials. The particularly preferred textiles are cotton, viscose, wool, linen, silk and blends thereof.

The ink used in the second aspect of the invention comprises a solution in water of a reactive dye and optionally a water miscible organic solvent.

The preferred water miscible solvent comprises a $C_{1-4}$-alcohol or $C_{1-4}$-diol, for example ethylene glycol, propane-1,2-diol, butane-1,2-diol or a mixture thereof.

The ink preferably comprises a solution in water of a dye having at least one cellulose reactive group and, a humectant, comprising a polyol having not more than one primary hydroxy group, provided that the composition contains not more than 10% by weight with respect to the humectant of one or more compounds from the group (a) polyols having two or more primary hydroxy groups and (b) alcohols having a primary hydroxy group.

The reactive dye may be any dye which has sufficient stability in water at or below pH 7 to be formulated as a commercial aqueous ink. Preferred reactive dyes comprise one or more chromophores and one or more cellulose reactive groups. Examples of chromophores are azo, anthraquinone, triphendioxazine, formazan and phthalocyanine chromophores. Examples of cellulose reactive groups are monohalotriazine groups, especially chloro- or fluoro-triazine groups, vinylsulphone or sulphatoethylsulphone groups and halopyrimidine groups. Suitable reactive dyes include all those listed in the Colour Index. Especially preferred dyes comprise one or more azo, anthraquinone, triphendioxazine, formazan or phthalocyanine chromophore and one or more monochlorotriazine group.

The dye used in the ink is preferably purified by removal of substantially all the inorganic salts and by-products which are generally present in a commercial dye at the end of its synthesis. Such purification assists in the preparation of a low viscosity aqueous solution suitable for use in an ink jet printer.

To assist in the achievement of heavy depths of shades the dye should preferably have a water-solubility of at least 5%, and more preferably from 5% to 25%, by weight. Solubility of the dye can be enhanced by converting the sodium salt, in which form it is normally synthesised, either partially or wholly, into the lithium or ammonium salt. Purification and ion exchange can conveniently be effected by use of membrane separation processes which permit the separation of unwanted inorganic materials and by-products directly from an aqueous solution or dispersion of the dye followed by partial or complete exchange of the counter-ion. The ink preferably contains up to 20% by weight of dye and more preferably from 2% to 10%, especially from 3% to 8%.

The ink may also contain a humectant, which may also function as a water miscible solvent, which preferably comprises a glycol or dihydroxyglycolether, or mixture thereof, in which one or both hydroxy groups are secondary hydroxy groups, such as propane-1,2-diol, butane-2,3-diol, butane-1,3-diol and 3-(3-hydroxyprop-2-oxy)propan-2-ol. Where the humectant has a primary hydroxy group this is preferably attached to a carbon atom adjacent to a carbon atom carrying a secondary or tertiary hydroxy group. The humectant may comprise up to a total of 10% by weight of a polyol, especially a glycol or dihydroxyglycolether, having two or more primary hydroxy groups, such as ethyleneglycol, propane-1,3-diol, butane-1,4-diol, 2-(2-hydroxyethoxy)ethanol and 2-(2-[2-hydroxyethoxy]ethoxy)ethanol and/or an alcohol with a primary hydroxy group, such as ethanol, n-propanol and n-butanol, However, it preferably contains not more than 5%, by weight, and is more preferably free from, such compounds. In the context of the humectant, the term "alcohol" means a compound having only one hydroxy group attached to an aliphatic carbon atom. The ink preferably contains from 5% to 25%, by weight, more especially from 10% to 20%, of humectant.

If desired, the ink may be buffered to a pH from 5 to 8, especially to a pH from 6 to 7, with a buffer such as the sodium salt of metanilic acid or an alkali metal phosphate.

The ink preferably also contains one or more preservatives to inhibit the growth of fungi, bacteria and/or algae because these can block the jet of the ink jet printing equipment. Where the ink jet printing technique involves the charging and electrically controlled deflection of drops the solution preferably contains a conducting material such as an ionised salt to enhance the accumulation of charge on the drop. Suitable salts for this purpose are alkali metal salts of mineral acids. The remainder of the ink is preferably water, especially deionised water to avoid the introduction of impurities into the ink.

According to a preferred aspect of the present invention there is provided a process for the coloration of a textile material, especially a cellulosic textile material, with a reactive dye which comprises the steps of:

(a) contacting the textile material with a pre-treatment composition according to the invention to give a pre-treated textile material;
(b) removing water from the pretreated textile material to give a dry pre-treated textile material;
(c) applying to the dry pre-treated textile material by ink jet printing and ink comprising an aqueous solution of a reactive dye; and
(d) heating the dry printed textile material (i.e. the product step (c)) at a temperature from 100° C. to 200° C. for up to 10 minutes in order to fix the dye contained in the ink to the textile material.

In Stage (a) of the present process the pre-treatment composition is preferably evenly applied to the textile material. Where a deeply penetrated print or a deep shade is required the pre-treatment composition is preferably applied by a padding or similar process so that it is evenly distributed throughout the material. However, where only a superficial print is required the pre-treatment composition can be applied to the surface of the textile material by a printing procedure, such as screen or roller printing, ink jet printing or bar application.

In stage (b) of the present process, water may be removed from the pre-treated textile material by any suitable drying procedure such as by exposure to hot air or direct heating, e.g. by infra-red radiation, or microwave radiation, preferably so that the temperature of the material does not exceed 100° C.

The application of the ink to the dry pretreated textile material, stage (c) of the present process, may be effected by any ink jet printing technique, whether drop on demand (DOD) or continuous flow. Where the ink jet printing technique involves the charging and electrically-controlled deflection of drops the composition preferably also contains a conducting material such as an ionised salt to enhance and stabilise the charge applied to the drops. Suitable salts for this purpose are alkali metal salts of mineral acids.

In stage (d) of the present process, the printed textile material is preferably submitted to a short heat treatment, preferably after removal of water by low-temperature drying, at a temperature from 100° C. to 200° C. by exposure to dry or steam heat for a period of up to 20 minutes in order to effect reaction between the dye and the fibre and thereby to fix the dye on the textile material. If a steam (wet) heat treatment is used, the printed material is preferably maintained at 100°-105° C. for from 5 to 15 minutes whereas if a dry heat treatment is employed the printed material is preferably maintained at 140°-160° C. for from 2 to 8 minutes.

After allowing the textile material to cool, unfixed dye and other ingredients of the pre-treatment and dye compositions may be removed from the textile material by a washing sequence, involving a series of hot and cold washes in water and aqueous detergent solutions before the textile material is dried.

According to further aspects of the present invention there is provided a textile material, especially a cellulosic textile material, coloured by a process according to the present invention.

The present invention is further illustrated with reference to the following examples in which all parts and percentages are by weight unless otherwise indicated.

EXAMPLE 1

A first pre-treatment composition, hereinafter referred to as PTC1, was prepared by mixing 2.5 parts of sodium bicarbonate, 5 parts urea, 15 parts of a 10% aqueous solution of sodium alginate thickening agent (MANUTEX F from Kelco International Ltd) and 77.5 parts of water.

A colour enhancing agent was prepared having the following composition:

| Component | Parts by weight |
|---|---|
| Urea | 25 |
| Distearyl Dimethyl Ammonium Chloride | 2.3 |
| Isopropyl Alcohol | 0.8 |
| Castor Oil + 2.5 Ethylene Oxide | 2.2 |
| Castor Oil + 4.0 Ethylene Oxide | 0.36 |
| Sodium Lauryl Sulphate | 0.010 |
| Methanol | 0.007 |
| Formaldehyde | 0.0001 |
| Tallow Amine + 15 Ethylene Oxide | 0.25 |
| Acetic Acid (80%) | 0.05 |
| Water | 69.0 |
| Total | 100 |

this preparation is herein after referred to as colour enhancer CE1.

A second pre-treatment composition, hereinafter referred to as PTC2, was prepared by mixing 20 parts colour enhancer GE1, 2.5 parts sodium bicarbonate, 15 parts of a 10% aqueous solution of sodium alginate thickening agent and 62.5 parts of water.

A sheet of mercerised cotton fabric (125 gm/kilo) was thoroughly soaked with PTC1 in a padding bath and the excess liquor removed by mangling. The cotton was dried in hot air below 100° C.

A second sheet of mercerised cotton fabric (125 gm/kilo) was also thoroughly soaked with PTC2 in a padding bath and dried in hot air below 100° C.

Each of the two fabrics was printed using the 4 colour Stork ColorProofing BV Excelerator 4/1120 Continuous Jet Printer using the reactive ink formulations supplied. The inks contained a charging agent and the following ingredients:

Ink 1 C.I. Reactive Yellow 85 (6 parts), Diethylene Glycol, (15 parts), water (79 parts)
Ink 2 C.I. Reactive Red 31 (6 parts), Diethylene Glycol, (15 parts), water (79 parts)
Ink 3 C.I. Reactive Blue 71 (6 parts), Diethylene Glycol, (15 parts), water (79 parts)
Ink 4 C.I. Reactive Black 8 (6 parts), Diethylene Glycol, (15 parts), water (79 parts)

After ink jet printing each of the four inks onto the two fabrics, which had been padded with either PTC1 or PTC2, the fabrics were dried in hot air below 100° C. The dried cotton fabrics were then submitted to a steam heat treatment at 100°–102° C. for 10 minutes, followed by a wash-off treatment of a cold rinse, hot soap, cold rinse, followed by a final drying treatment.

The colour yield of the four inks on the two pre-treatments was assessed by reflectance spectrophotometry using the method of Derbyshire and Marshall (J. Society of Dyers and Colourists, volume 96 (1980) page 166) which is based on the Kubelka-Munk equation (Z. Techn. Physik, volume 12 (1931) page 593) and termed the 'Integ' value.

This is calculated by the following equation:

$$\text{Integ} = \sum_{400}^{700} |\lambda, F\lambda, (\bar{x}\lambda + \bar{y}\lambda + \bar{z}\lambda)$$

where $$F\lambda = \frac{[1 - (R\lambda - R_O)]^2}{2(R\lambda - R_O)} - \frac{[1 - (R_S - R_O)]^2}{2(R_S - R_O)}$$

$R_\lambda$ reflectance of the print at wavelength $\lambda$ $R_s$ reflectance of the undyed substrate at the same wavelength $R_o$ constant $I_\lambda$ is the spectral energy of illuminant D65

$\bar{x}$, $\bar{y}$, $\bar{z}$ are the 10° standard observer data

The resultant colour yields for cotton pretreated with PTC1 or PTC2 were as follows:

| INK | PRETREATMENT PTC1 | PRETREATMENT PTC2 |
|---|---|---|
| Ink 1 | 13.4 | 17.5 |
| Ink 2 | 15.4 | 18.5 |
| Ink 3 | 4.8 | 6.8 |
| Ink 4 | 24.1 | 32.6 |

The colour yield in the case of PTC2 pre-treatment was in all cases greater than that for PTC1 pre-treatment. In addition the brightness of the print and the definition of the inks printed in the case of pre-treatment PTC2 was superior to that when pre-treatment PTC1 was used. The handle of the finished print on pre-treatment PTC2 was superior to PTC1.

Small scale patterns and colours produced in the present process were found to correlate well with those produced by conventional reactive dye printing and the high degree of correlation allows the printer to assess a design and colours on the appropriate substrate on a small scale before incurring the high cost of engraving production scale screens or rollers.

EXAMPLE 2

The method detailed in Example 1 was repeated except that in place of colour enhancing agent CE1 there was used colour enhancing agent having the following composition:

| Component | Parts by weight |
|---|---|
| Tetra Octyl Ammonium Bromide | 2.0 |
| Isopropyl alcohol | 0.7 |
| Water | 97.3 |

-continued

| Component | Parts by weight |
|---|---|
| Total | 100.0 |

This colour enhancing agent is hereinafter referred to as CE2.

A pre-treatment composition, hereinafter referred to as PTC3, was prepared in an identical manner to the second pre-treatment composition described in Example 1 except that in place of CE1 there was used 20 parts of CE2.

PTC3 was applied to a sheet of mercerised cotton fabric, the fabric was dried and printed in an identical manner to that described in Example 1.

The resulting colour yield of the four prints resulting from pre-treatment with PTC3, as judged by visual inspection, was in all cases greater than that for the control PTC1.

EXAMPLES 3 to 10

The method of Example 2 may be repeated except that in place of Tetra Octyl Ammonium Bromide there is used an equivalent amount of the ammonium compound listed below:

| Example | Ammonium Compound |
|---|---|
| 3 | tridecyl ammonium chloride |
| 4 | Tridodecyl ammonium sulphate |
| 5 | tetradecyl ammonium chloride |
| 6 | tridecyl methyl ammonium chloride |
| 7 | Tridodecylmethyl ammonium chloride |
| 8 | distearyl diethyl ammonium chloride |
| 9 | distearyl dipropyl ammonium bromide |
| 10 | distearyl dimethyl ammonium sulphate |

We claim:

1. A colour enhancing agent comprising:

| | | |
|---|---|---|
| Urea | from 10 | to 30%; |
| Quaternary ammonium compound | from 1 | to 20%; |
| Solubility enhancing agent | from 0.1 | to 2.5%; |
| Sodium lauryl sulphate | from 0.001 | to 0.5%; |
| Tallow amine + 15 ethylene oxide | from 0.01 | to 0.5%; |
| Castor oil + 2.5 or 4.0 ethylene oxide | from 1 | to 5%; and |
| Water | from 60 | to 80%; |

wherein the Quaternary ammonium compound is of the formula (1):

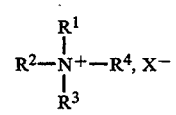

(1)

wherein:

$R^1$, $R^2$ and $R^3$ are each independently selected from H and $C_{1-20}$-alkyl or alkylene;

$R^4$ is $C_{1-20}$-alkyl or alkylene; and $X^-$ is an anion, provided that the total number of carbon atoms in the compound of formula (1) is more than 30.

2. A pre-treatment composition comprising a colour enhancing agent according to claim 1, a base, and a thickening agent.

3. A pre-treatment composition according to claim 2 comprising 5% to 50% of the colour enhancing agent, 1% to 5% alkali metal hydroxide, carbonate, bicarbonate or a mixture thereof, 10% to 20% alginate thickener and the balance water.

4. A pre-treatment composition according to claim 2 which does not contain a dye.

5. A process for the coloration of a textile comprising the steps of:

(i) applying to the textile a pre-treatment composition according to claim 2; and (ii) ink jet printing the product from step (i) with an ink containing a reactive dye.

6. A process according to claim 5 for the coloration of a cellulosic textile material comprising the steps of:

(a) contacting the textile material with a pre-treatment composition according to claim 2 to give a pre-treated textile material;

(b) removing water from the pretreated textile material to give a dry pre-treated textile material;

(c) applying to the dry pre-treated textile material by ink jet printing and ink comprising an aqueous solution of a reactive dye; and (d) heating the dry printed textile material at a temperature from 100° C. to 200° C. for up to 10 minutes in order to fix the dye contained in the ink to the textile material.

7. A textile material coloured by a process according to claim 5 or 6.

* * * * *